US007140791B2

(12) United States Patent
Van Bever

(10) Patent No.: US 7,140,791 B2
(45) Date of Patent: Nov. 28, 2006

(54) VERTICAL AUTOSIZING PRINTING SYSTEM

(75) Inventor: Mario Van Bever, Evergem (BE)

(73) Assignee: DYMO, Sint-Niklaas (BE)

( * ) Notice: Subject to any disclaimer, the term of this patent is extended or adjusted under 35 U.S.C. 154(b) by 0 days.

(21) Appl. No.: 10/975,409

(22) Filed: Oct. 29, 2004

(65) Prior Publication Data

US 2005/0147441 A1 Jul. 7, 2005

(30) Foreign Application Priority Data

Oct. 29, 2003 (GB) ..... 90325264.0

(51) Int. Cl.
*B41J 21/17* (2006.01)
*B41J 11/42* (2006.01)

(52) U.S. Cl. ..... 400/70; 400/582

(58) Field of Classification Search ..... 400/582, 400/70, 61, 615.2, 208, 613, 76; 345/648
See application file for complete search history.

(56) References Cited

U.S. PATENT DOCUMENTS 4,815,871 A * 3/1989 McGourty et al. ..... 400/120.16
4,927,278 A * 5/1990 Kuzuya et al. ..... 400/208
4,966,476 A * 10/1990 Kuzuya et al. ..... 400/208
5,230,572 A * 7/1993 Hirono et al. ..... 400/3
5,344,247 A * 9/1994 Sakuragi et al. ..... 400/582
5,456,545 A * 10/1995 Sims et al. ..... 400/708
5,520,469 A * 5/1996 Owa ..... 400/76
5,540,510 A * 7/1996 Sims et al. ..... 400/208
5,551,785 A * 9/1996 Mori et al. ..... 400/76
5,649,775 A * 7/1997 Sakuragi et al. ..... 400/615.2
5,761,338 A * 6/1998 Kasamatsu ..... 382/176
5,987,270 A * 11/1999 Hulan et al. ..... 399/45
6,302,603 B1 * 10/2001 Akaiwa et al. ..... 400/613
6,532,078 B1 * 3/2003 Hayama ..... 358/1.15
6,829,058 B1 * 12/2004 Kumada ..... 358/1.15
6,909,525 B1 * 6/2005 Sato ..... 358/449

FOREIGN PATENT DOCUMENTS

| | | |
|---|---|---|
| EP | 0557137 | 2/1993 |
| EP | 0819542 | 7/1996 |
| EP | 0855282 | 7/1998 |
| EP | 1040928 | 10/2000 |
| WO | 99/38692 | 8/1999 |

* cited by examiner

*Primary Examiner*—Andrew H. Hirshfeld
*Assistant Examiner*—Wasseem H. Hamdan
(74) *Attorney, Agent, or Firm*—Marshall, Gerstein & Borun LLP

(57) ABSTRACT

A method for printing an image on an elongate image receiving medium includes the steps of: inputting data defining the image to be printed; selecting a vertical printing mode in which the image is to be printed across the width of the elongate image receiving medium; initiating a print operation for printing the image; generating print data, after vertical printing mode has been selected and the print operation has been initiated in accordance with a print data generation method which ensures that the image fits in the width of the elongate receiving medium; and printing the image using the print data.

14 Claims, 6 Drawing Sheets

230 220

| No. of Characters | Font size |
|---|---|
| 1<br>2<br>3 | L |
| ⋮ | M |
| ⋮ | S |
| N - 1<br>N | XS |

FIG. 5a

| Tape Width | No. of characters | Font size |
|---|---|---|
| | 1<br>2 | L |
| | ⋮ | M |
| | ⋮ | S |
| | N | XS |
| | 1<br>2 | L |
| | ⋮ | M |
| | ⋮ | S |
| | M | XS |
| | 1<br>2 | L |
| | ⋮ | M |
| | ⋮ | S |
| | X | XS |

FIG. 5b

VERTICAL AUTOSIZING PRINTING SYSTEM

The present invention relates to a method of printing an image on an image receiving medium, such as a tape, and in particular to printing the image across the width of the printing medium.

There have been known for many years thermal printing devices which produce labels on an elongate medium such as tape. Such devices operate with a supply of tape arranged to receive an image and a means for transferring an image onto the tape. In one known device, a tape holding case holds a supply of image receiving tape and a supply of image transfer ribbon, the image receiving tape and the image transfer ribbon being passed in overlap through a print zone of the printing device. At the print zone, a thermal print head cooperates with a platen to transfer an image from the transfer ribbon to the tape. A printing device operating with a tape holding case of this type is described for example in EP-A-0267890 (Varitronics Inc.). In this printing device, the image receiving tape comprises an upper layer for receiving an image which is secured to a releasable backing layer of adhesive.

In another device, the construction of the image receiving tape is such that the upper image receiving layer is transparent and receives an image on one of its faces printed as a mirror image so that it is viewed the correct way round through the other face of the tape. In this case, a double sided adhesive layer can be secured to the upper layer, this double sided adhesive layer having a releasable backing layer. This latter arrangement is described for example in EP-A-032918 and EP-A-0322919 (Brother Kogyo Kabushiki Kaisha).

Printing devices of this type also include display means and an input means such as a keyboard for selecting characters to be printed. Selected characters are displayed on the display means and in this way a user can compose a label to be printed. When a label has been composed a print instruction is given and the printing device proceeds to print a label. Printing devices of this type also include cutting means to cut off the printed portion of the tape to enable it to be used as a label. For use as a label, the releasable backing layer is removed from the upper layer to enable the upper layer to be secured to a surface by means of the adhesive layer. In this way, labels having a character arrangement determined by the user can be made.

The image may be printed on the tape in either a horizontal or vertical orientation to the length of the tape. When the image is printed horizontally, that is along the length of the tape, the user may determine the length of the image, practically without a limit. However, when an image is printed vertically, that is across the width of the tape, the length of the image is limited to the width of the tape. This may present a number of problems to the user when determining whether an image can be printed across the width of the tape and whether the printed image will be legible when printed. Printing text in a vertical direction is however very desirable since it is very useful for spine labels and the like.

FIG. 7 shows four labels (a)–(d), each having text arranged in a vertical orientation. Each label has characters arranged such that each character is orientated vertical to the length of the tape. In label (a), each character is printed beneath the other, such that although the characters are printed vertically, the image is printed along the length of the tape. In this case, the length of the image is not limited to the width of the tape. Label (b) shows another example of where characters are printed vertically and the image is printed along the length of the tape. Here two words, 'Tape' and 'Printer' are included in the character string. The words in the character string are separated by including a blank space along the length of the tape.

In label (c), each character is printed adjacent to the other such that the image extends across the width of the tape. In this case the length of the image is restricted by the width of the tape. Label (d) shows another example of this type of vertical printing. Here, two words have been separated by printing the words beneath the other.

It can be seen that if a user wishes to print a label with an image arranged vertically as shown in FIGS. 7(*c*) and 7(*d*), it is necessary to ensure that the image may be printed within the width of the tape. U.S. Pat. No. 5,344,247 (Brother Kogyo Kabushiki Kaisha) describes a printer capable of printing an image onto a tape along the longitudinal direction of the tape. The printer is also capable of rotating the image such that the image is printed in a rotated fashion with respect to the longitudinal direction of the tape. After the image has been rotated, an iterative process incrementally reduces the length of the rotated image comparing the length of the image and the width of the tape after each iteration, until it is eventually determined that the image is a size that can be printed on the tape.

Such methods for printing an image across the width of the tape involve complex algorithms that require a large amount of processing. This increases the memory requirements for the printer and thus increases cost.

It is therefore an aim of the invention to overcome the problems identified in the prior art and to provide an improved method for printing vertical images.

The present invention seeks to overcome these problems when printing within a predefined area, such as across the width of the tape.

According to a first aspect of the present invention there is provided a method for printing an image on an elongate image receiving medium comprising the steps: inputting data defining the image to be printed; selecting a vertical printing mode in which the image is to be printed across the width of the elongate image receiving medium; initiating a print operation for printing the image; generating print data, after vertical printing mode has been selected and the print operation has been initiated in accordance with a print data generation method which ensures that the image fits in the width of the elongate receiving medium; and printing the image using the print data.

In a preferred embodiment of the present invention the print data generation method operates without iterative calculation of size data of at least one character defining the image to be printed.

In the preferred embodiment of the present invention the print data generation method further comprises the steps of comparing a calculated length of the image to a predetermined range, selecting a second character size as a result of the comparison and printing said image with said second character size.

In an alternative embodiment of the present invention the method further comprises the steps of enlarging the image with a second character size if the calculated length of the image is less than said a predetermined length, calculating the length of the image enlarged with the second character size and comparing the calculated length to the first predetermined length.

In a further alternative embodiment of the present invention the character size is determined from a look up table.

According to a second aspect of the present invention there is provided a printer arranged to print an image on an elongate image receiving medium comprising: input means for inputting data defining the image to be printed; selecting means for selecting a vertical printing mode in which the image is to be printed across the width of the elongate image receiving medium; print operation initiating means for initiating a print operation for printing the image; print data generating means arranged to generate print data after vertical printing mode has been selected and the print operation has been initiated in accordance with a print data generation method which ensures that the image fits in the width of the elongate receiving medium; and printing means arranged to print the image using the print data.

For a better understanding of the present invention, and to show how the same may be carried into effect, reference will now be made by way of example to the accompanying drawings in which:—

FIGS. 5*a* and *b* representations of look up tables used in an embodiment of the invention.

Figure 6:
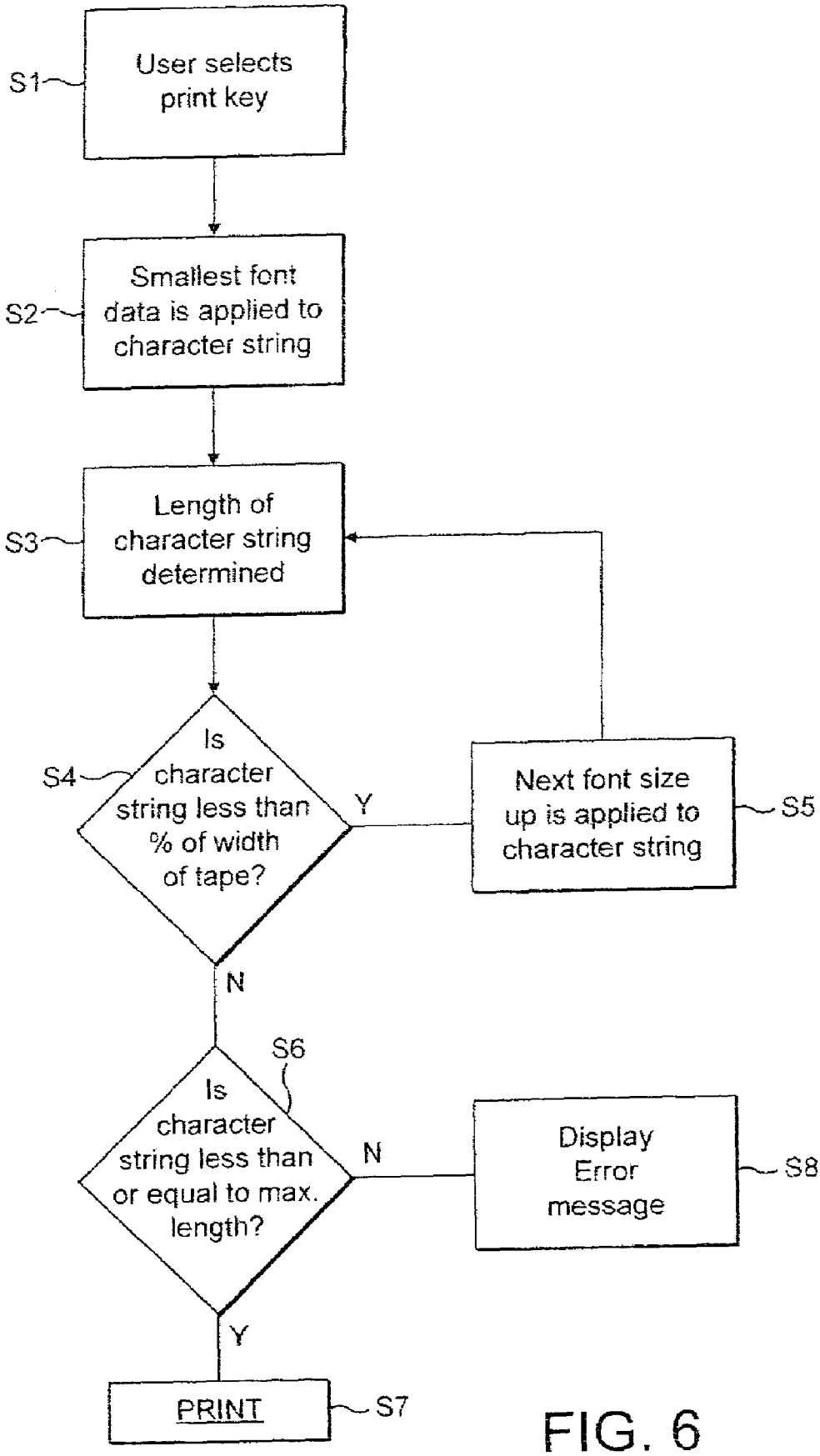
Figure 7:
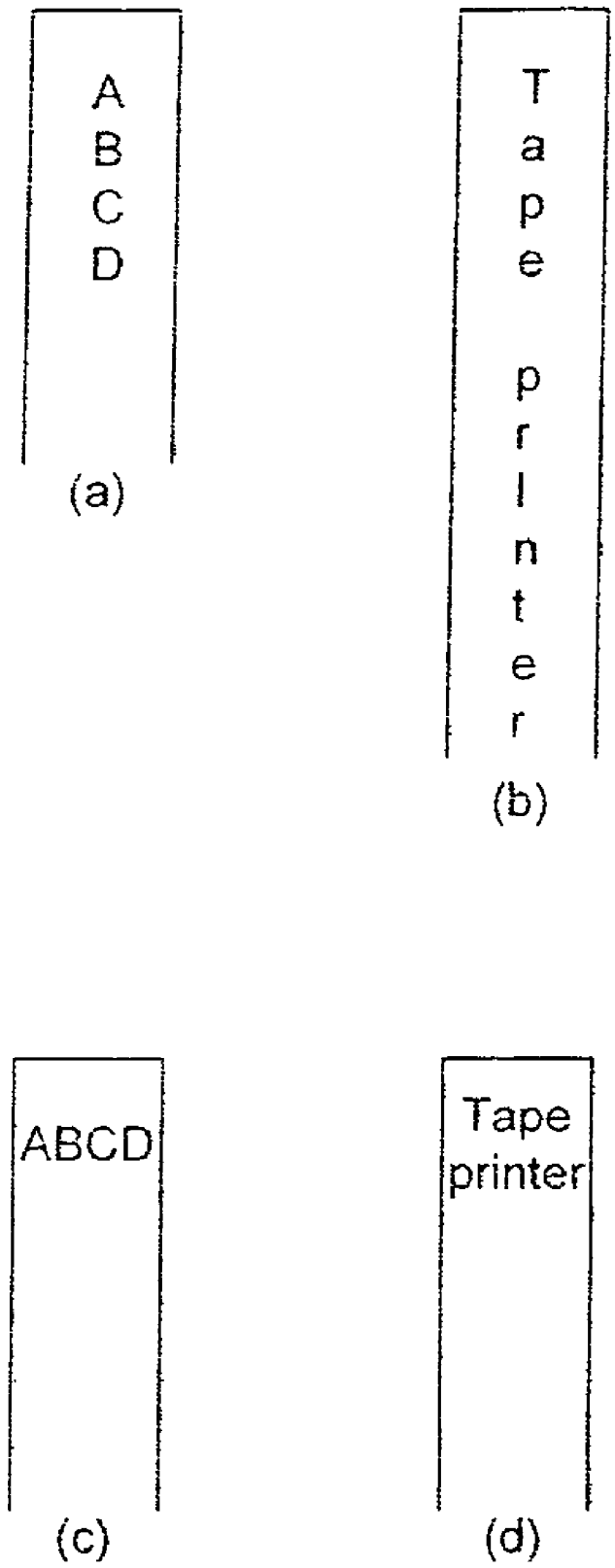

FIG. 6 is a flow chart showing an alternative embodiment of the present invention.

FIGS. 7*a–d* show examples of vertical printing.

Figure 1:
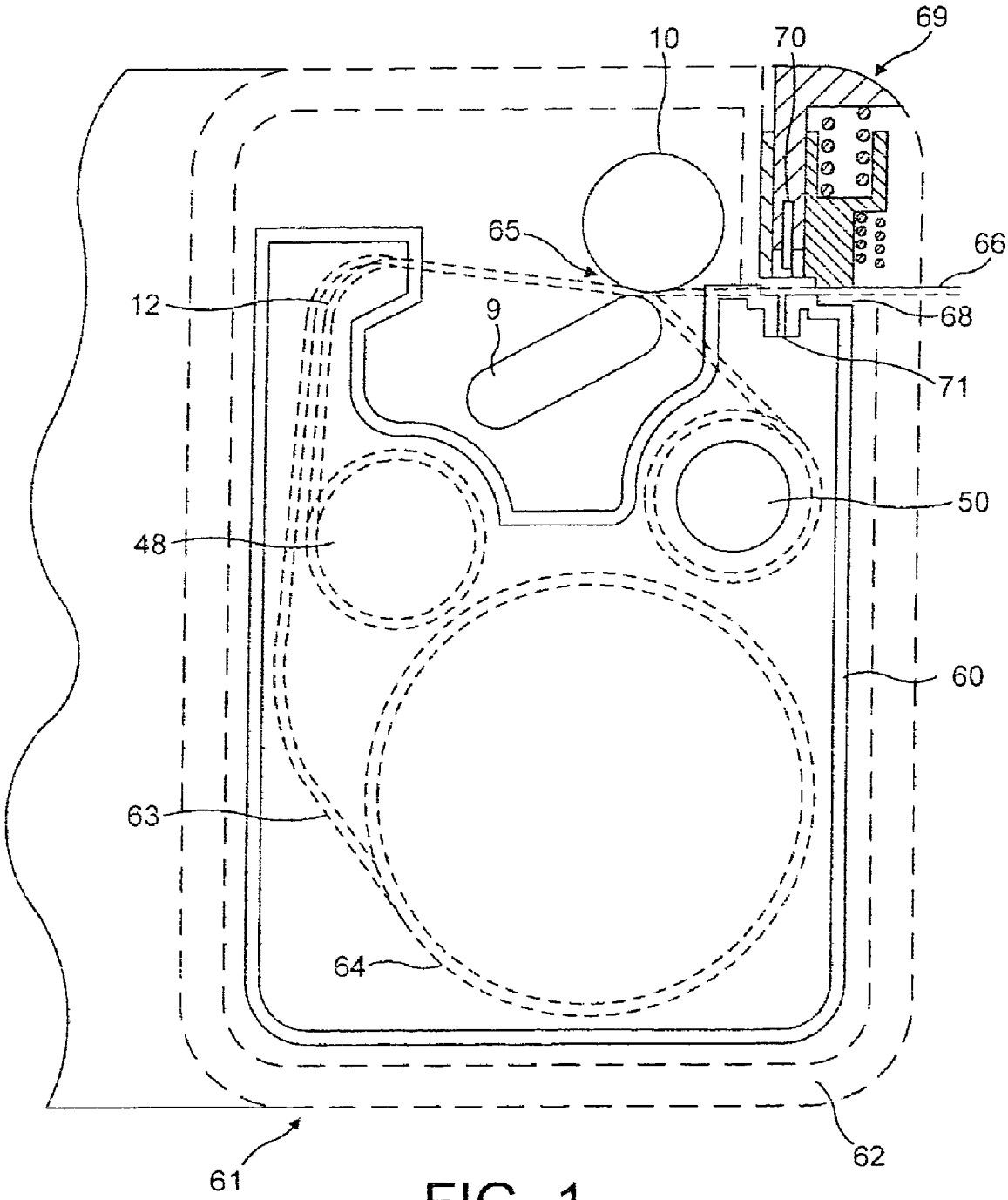
FIG. 1 is a schematic cross sectional view of a tape printing device embodying the present invention.

FIG. 1 shows in plan view a tape printing device 61 embodying the present invention which has a cassette 60 arranged therein. Typically this tape printing device 61 is a hand-held or small desktop device. The cassette 60 is located in a cassette bay 62 and contains a supply spool 64 of image receiving tape 63. The cassette bay 62 also accommodates a thermal print head 9 and a platen 10 which cooperate to define a print zone 65. The cassette 60 also has an ink ribbon supply spool 48 and an ink ribbon take up spool 50. An ink ribbon 12 is guided from the ink ribbon supply spool 48 through the print zone 65 and taken up on the ink ribbon take up spool 50. The image receiving tape 63 passes in overlap with the ink ribbon 12 through the print zone 65 with its image receiving layer in contact with the ink ribbon12. The print head 9 is movable so that it can be brought into contact with the platen 10 for printing and moved away from the platen 10 to enable the cassette 60 to be removed and replaced. In the operative position, the platen 10 is rotated to cause the image receiving tape 63 to be driven past the print head 9 and the print head is controlled to print an image on the image receiving tape 63 by thermal transfer of ink from the ink ribbon 12. The printhead 9 comprises a thermal print head having an array of printing elements connected in parallel, each of which can be thermally activated in accordance with the desired image to be printed. The image receiving tape 63 is guided by a guide mechanism (which is not shown) through the cassette 60 to an outlet 66 of the tape printing device 61.

The platen 10 is driven by a DC motor 67 (see FIG. 3) so that it rotates to drive the image receiving tape 63 through the print zone 65 of the tape printing device 61 during printing. In this way, an image is printed on the tape and fed out from the print zone 65 to the outlet 66.

The image is printed by the print head 9 on the image receiving tape 63 on a column by column basis with the columns being adjacent one another in the direction of movement of the tape 63. Pixels are selectively activated in each column to construct an image in a manner well known in the art. The DC motor 67 is provided with a shaft encoder for monitoring the speed of rotation of the motor. Sequential printing of the columns of pixels by the printhead 9 is controlled in dependence on the monitored speed of rotation of the motor 67. The control of the speed of the motor 67 is achieved by the microprocessor chip 100 (see FIG. 4) to generate data strobe signals each of which causes a column of pixel data to be printed by the print head 9.

The tape printing device 61 may include at cutting location 68 a cutting mechanism 69 which carries a blade 70. The blade 70 cuts the image receiving tape 63 then enters a slot 71 located in the cassette 60.

Figure 2:
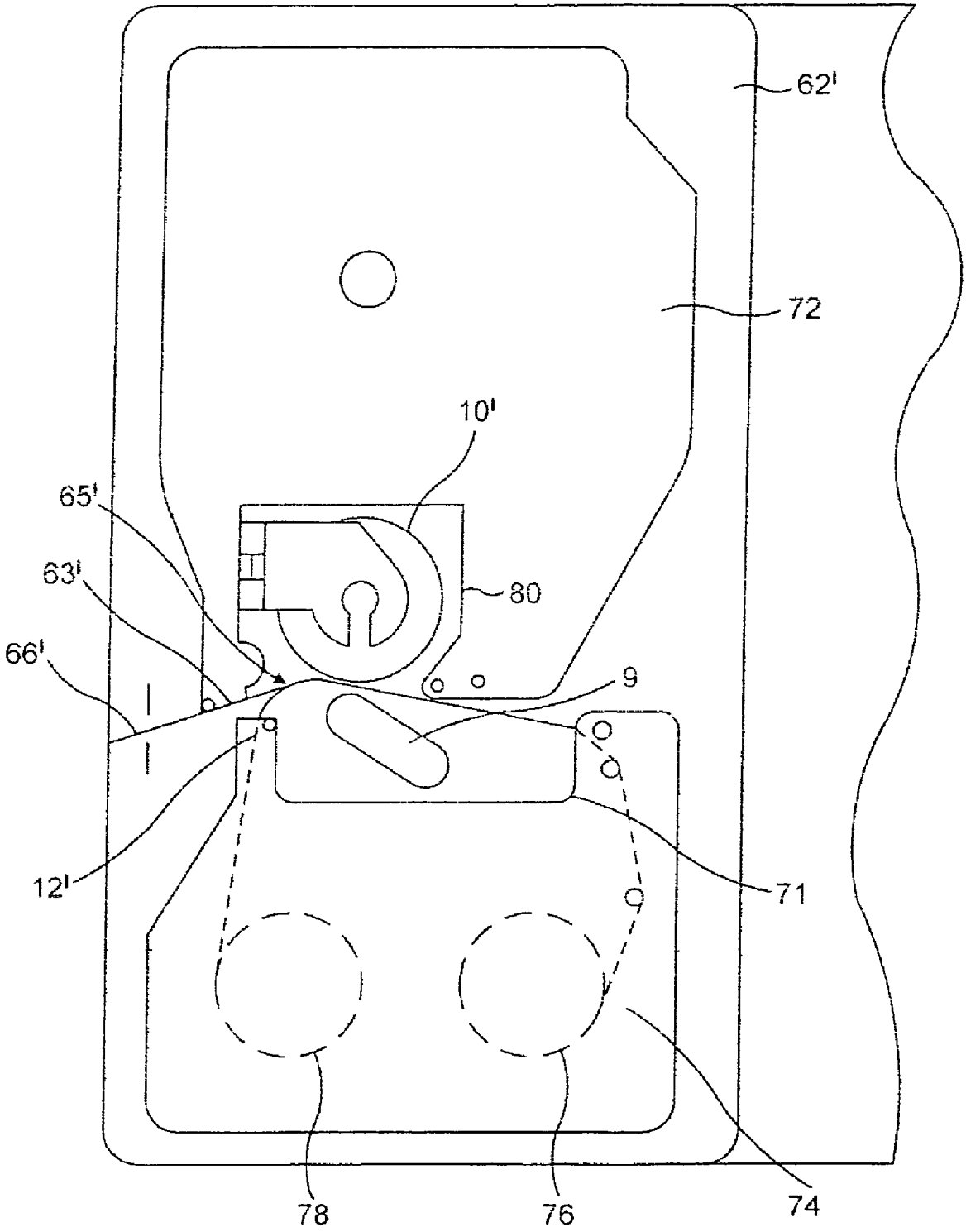
FIG. 2 is a schematic cross sectional view of a tape printing device in accordance with an alternative embodiment of the present invention.

FIG. 2 shows an alternative embodiment of the present invention. FIG. 2 shows a printer having two cassettes arranged in a cassette receiving bay 62' of a printing device. The upper cassette 72 contains a supply of the image receiving tape 63' which passes through a print zone 65' of the printer to an outlet 66' of the printer. The image receiving tape 63' comprises an upper layer for receiving a printed image on one of its surfaces and having its other surface coated with an adhesive layer to which is secured to a releasable backing layer. The cassette 72 has a recess 80 for accommodating a platen 10' of the printer. The platen 10' is mounted for rotation.

The lower cassette 74 contains an ink ribbon 12 which extends from a supply spool 76 to a take up spool 78 within the cassette 74. The ink ribbon 12 extends through the print zone 65' in overlap with the image receiving tape 63'. The cassette 74 has a recess 71 for receiving the printhead 9' of the printer. The print head 9' is movable between an operative position, in which it bears against the platen and holds the ink ribbon 12' and the image receiving tape 73 in overlap between the print head 9 and the platen 10 and an inoperative position in which it is moved away from the platen to release the thermal transfer ribbon and the image receiving tape. In the operative position the platen 10 is rotated under the action of a DC motor 67' in a manner as described in relation to FIG. 1. The print head is controlled to print an image onto the image receiving tape by thermal transfer of ink from the ribbon.

The ink ribbon can be omitted in certain embodiments where the image receiving tape is of a thermally sensitive material. In this case, the image is printed by the thermal print head directly onto the thermally sensitive image receiving tape.

Figure 4:
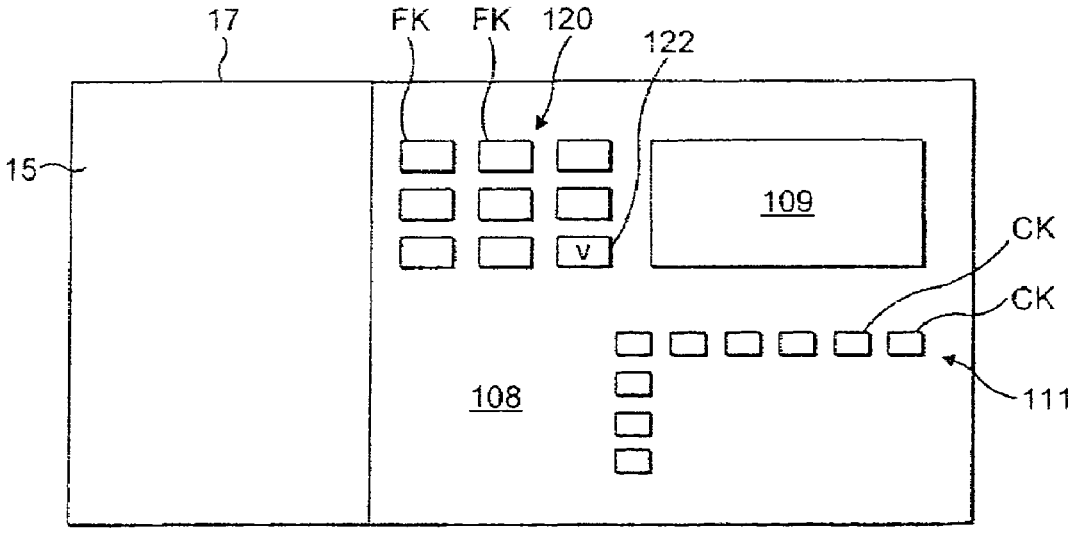
FIG. 4 is a plan view of the top surface of the printing device.

FIG. 4 is a view of the printer from above. The cassette receiving bay 62 is covered by a lid 15 hinged along the line 17 at the rear of the printer and which can be opened from the front to reveal the cassette, or cassettes (depending on the embodiment) in the cassette receiving bay 62. The printer also has a keyboard 108 which has a plurality of character keys CK designated generally by arrow 111 and a plurality of function keys FK designated generally by 120.

Figure 3:
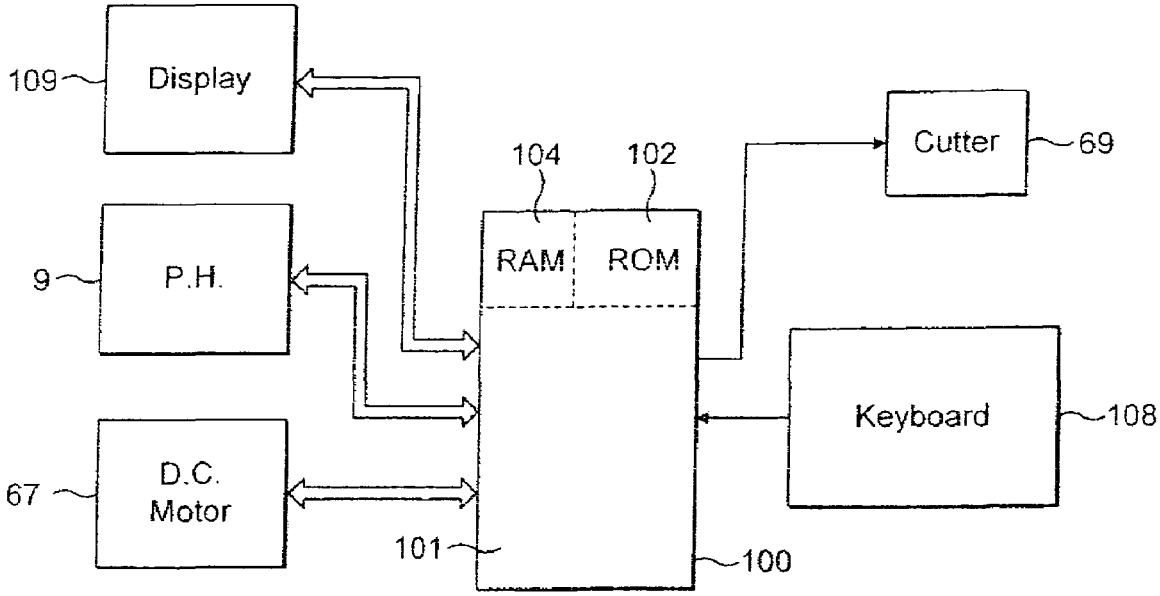
FIG. 3 is a diagrammatic sketch showing control circuitry for the printing device of FIG. 1 according to an embodiment of the present invention.

The basic circuitry for controlling the present invention of the printing device is shown in FIG. 3. There is a microprocessor 100 chip having a read only memory (ROM) 102, a microprocessor 101 and random access memory capacity (RAM) 104. The microprocessor chip 100 outputs data to drive a display via a display driver chip 109 to display a label to be printed (or part thereof) and/or a message for the user. The display driver alternatively may form part of the microprocessor chip. The microprocessor receives an input from keyboard 108. Additionally, the microprocessor chip 100 also outputs data to drive the print head 9 to form a label. The microprocessor chip 100 also controls the DC motor 67 driving the platen 10. The microprocessor may also control the cutting mechanism 69 to allow lengths of tape to be cut off.

The ROM 102 stores font data defining alphanumeric characters. Characters to be printed by the printhead are derived from the font data. Characters for display by the display means may also be derived from the same font data stored in the ROM used to derive print data, or may be derived from separate font data stored at a separate location in the ROM. Font data may be stored as compressed data e.g. Bezier as or bitmap information. It will be appreciated that different variations of the characters can be produced from the font data stored in the ROM by manipulation by the microprocessor 101 using the memory capacity of the RAM 104. For example, characters of different sizes to be printed can be produced. In order to print a character from Bezier data an appropriate scaling factor may be applied to the font data. Alternatively, an already sized bit map version of the character can be used.

Characters to be printed are entered into the printing device using the character keys designated generally referred to by the block 111 but in practice comprising a plurality of lettered and numbered keys CK. As each character is entered using the keyboard 108, the keyboard inputs information to the microprocessor 101 which drives the display 109 to display the characters as they are inputted. To do this, for each character which is entered, the microprocessor calls up the stored font data for forming that character from the ROM 102. The font data for that character is copied to the RAM 104 and is manipulated by the microprocessor 101 to generate pixel data representing the character. This pixel data is transferred to the display 108 and the character is displayed. The generation of print data from the stored font data will be described herein after.

In an embodiment of the present invention, the printing device may be arranged to print on image receiving tapes of different widths. Therefore, the printing device may be provided with a sensing arrangement to determine the width of the tape in the cassette installed. When a cassette holding an image receiving tape is inserted into the printing device, the sensing arrangement (not shown) determines the width of the tape. The determined width is then stored in the RAM of the microprocessor. A suitable sensing arrangement is disclosed in our European Patent EP0574165, the contents of which are hereby incorporated by reference.

In a further embodiment of the present invention, tape width is detected by the location of a tape size switch. Cassettes having tapes of different sizes have a recess in different positions. A tape size switch is located in the cassette bay. The user is required to adjust the switch to the correct location to match the recess such that the tape cassette can be inserted, thus indicating the width of the tape. An arrangement of this kind is disclosed in our European Patent EP0634274, the contents of which are hereby incorporated by reference.

Various functions of the printing device may be selected using function keys FK. Vertical printing mode may be selected by selecting a vertical mode function key 122. Vertical printing mode causes an image such as a character string to be printed such that the character string extends across the tape width, i.e., the image is printed perpendicular to the length of tape, with characters rotated through 90 degrees, see FIG. 7.

In an embodiment of the present invention, the vertical printing mode is only operational when a tape having a particular tape width is installed, e.g., the largest width.

In an alternative embodiment of the invention, vertical print mode may be operational for different tape widths. In such embodiments, the maximum printable length of an image printed across the tape will depend on the width of the tape, since the length of the printed image cannot exceed the width of the tape.

In further embodiments of the invention, the width of the tape installed in the printer may exceed the height of the print head. In such embodiments the maximum length of an image printed across the width of the tape will be equal to the height of the print head. For example, if the print head height is 13.5 mm the maximum length of an image printed across 19 mm width tape will be 13.5 mm.

In accordance with an embodiment of the invention when vertical print mode is selected, print data is not generated until a print operation is executed. When vertical mode is selected and a character string is entered, the characters are displayed on the display as each character is selected on the keyboard as, discussed above. An icon indicating that vertical mode has been activated, may also be displayed on the display.

In a preferred embodiment of the present invention when the user selects vertical mode, the printer disables any facility that enables the user to manually select the size of the image.

When the user has completed entering the character string to be printed, the user may execute a print command by selecting a print key.

As previously described, font data may be stored in the ROM. In this embodiment bit map data is stored for small 'S' and extra small 'XS' fonts only. In response to the execution of a print command the microprocessor retrieves character width information for the small 'S' font data from the ROM for each character in the character string. The length of the character string in the small font is then calculated and the microprocessor executes the following algorithm:

```
Start
0 <= (length based on S font < tapewidth / 4 )
   decision: L font
tapewidth /4 <= length based on S font < tapewidth / 2
      decision: M font
tapewidth /2 <= length based on S font < tapewidth
   decision: S font
tapewidth <= length based on S font
     if XS-length > tapewidth then error
     if XS-length < tapewidth then decision XS
Stop
```

When executing the algorithm, the microprocessor compares the calculated length to distinct ranges in sequence. Firstly the length of the character string is compared to the range 0—tape width/4. If the length falls within this range, the microprocessor determines that the character string is to be printed in large font 'L'. If the length does not fall within this range the calculated length is compared to the second range tape width/4—tape width/2. If the calculated length falls within this range, the microprocessor determines that the character string is to be printed in medium font 'M'. If the length does not fall within this range the calculated length is compared to a third range tape width/2—tape width. If the calculated length falls within this range, the microprocessor determines that the character string is to be printed in small font 'S'.

If the calculated length does not fall within the third range, the microprocessor retrieves small 'XS' font data from the ROM for each character in the character string. The length of the character string in the extra small font is then calculated. If the length of the character string in extra small font is less than the tape width the microprocessor determines that the character string is to be printed in extra small font. However if the length of the character string in extra small font is larger than the tape width, an error message is displayed.

If it is determined that the character string should be printed in either large or medium font, the microprocessor then applies the appropriate decompression algorithm to the small font data forming each character in the character string retrieved from the ROM and copied to the RAM to generate print data representing each character. Alternatively, if it is determined that the character string should be printed in either small or extra small font, the font data is simply retrieved from the ROM and used to generate print data. This print data is then transferred column by column to the print head for printing.

In an alternative embodiment of the present invention, when the tape width exceeds the height of the print head, the algorithm used to calculate the font size uses the ranges '0—print head height/4'; 'print head height/4—print head height/2'; and 'print head height/2—print head height' as the first second and third ranges respectively.

In an alternative embodiment of the present invention, when the user selects the vertical mode, look up tables stored in the ROM may be used to indicate the printed size of the font of each character in the character string.

A separate look up table may be stored in the ROM for each width of tape which may be used in the printing device. The width of the tape may be input by the user or may be sensed using the tape width sensing arrangement described earlier. The microprocessor 100 uses the input tape width value to determine which look up table should be referred to in the vertical mode.

As shown in FIG. 5*a*, the look up table stores a list of font sizes, in column 220, that correspond to a list of the number of characters entered in the character string in column 230. The value of the number of characters, ranges from 1 to a maximum value N. N is a fixed value for each tape width, equal to the maximum number of characters that may be printed across the width of the tape in the smallest font.

Since the maximum number N of characters that can be printed across the tape, for each tape width is fixed, it may be advantageous to alert the user may to the maximum number of characters that may be input on one line. This may occur each time the user selects the vertical mode.

In another embodiment of the present invention a single look up table may be stored having a column that includes different tape widths as shown in FIG. 5*b*.

As described previously, when the user selects alphanumeric keys on the keyboard 108, display data is generated in the RAM and displayed on the display. When the print command is executed by the user, for example, by selecting a print function key on the keyboard the microprocessor determines the number of characters in the character string. Using the number of characters in the character string, and the width of the tape, the microprocessor refers to the look up table to determine the size print font to be used. The microprocessor then applies this size to the font data forming each character in the character string that has been copied to the RAM to generate print data representing each character. This print data is then transferred column by column to the print head for printing.

In an embodiment of the invention, when the vertical mode is activated, the user may be prevented from entering a greater number of characters than the maximum number of characters N that may be printed across the detected tape width.

In a further embodiment of the invention, if the number of characters in the character string exceeds the number of characters N that may be printed across the detected tape width, an error message will be displayed to the user when the user executes a print operation. Alternatively, or additionally, printing may be inhibited.

In a further embodiment of the invention, if the number of characters in the character string exceeds the number of characters N that may be printed across the detected tape width, the microprocessor will generate print data for, and print each set of N characters of the character string on adjacent lines until the entire character string has been printed.

An alternative embodiment of the present invention will now be described with reference to FIG. 6. FIG. 6 shows a flow chart describing the steps for generating print data when the user executes a print operation.

At step 1 of the flow chart the user executes a print operation with vertical mode selected, after having entered a character string to be printed.

At step 2 the microprocessor retrieves font data from the ROM for each character in the character string and copies it into the RAM. The font data that has been copied to the RAM is then sized to the smallest font that is printable by the printing device, in this example, extra small 'XS'. In an alternative embodiment of the invention, the font data stored in the ROM may be stored as bitmap data for the extra small font. In this case the font for each character in the character string is simply copied to the RAM.

At step 3 the length of the character string, is determined.

At step 4, the length of the character string is compared to the maximum printable length. As previously stated, in some embodiments of the present invention the maximum printable length will be equal to the width of the image receiving tape installed in the printing device. In practice the maximum printable length may be slightly less than the width of the tape so that margins, i.e. blank spaces may be provided between the edges of the tape and the image. Alternatively, when the width of the image receiving tape is greater than the height of the print head the maximum printable length is equal to the height of the printhead.

If the length of the character string is less than 75% of the maximum printable length the process continues to step 5 where the font data is sized to the next font size up. The process then returns to step 3.

If the length of the character string in the applied font size is equal to or larger than 75% of the maximum printable length, the process continues to step 6 where it is determined if the character string in the applied font is less than, or equal to the maximum printable length.

If the length of the character string is less than or equal to the maximum printable length, the process continues to step 7 and the character string is printed.

If the length of the character string is greater than the maximum printable length, the process continues to step 8 and an error message is displayed to the user.

The applicant draws attention to the fact that the present invention may include any feature or combination of features disclosed herein either implicitly or explicitly or any generalisation thereof, without limitation to the scope of any of the present claims. In view of the foregoing description it will be evident to a person skilled in the art that various modifications may be made within the scope of the invention.

The invention claimed is:

1. A method for printing an image on an elongate image receiving medium comprising the steps:

inputting data defining the image to be printed;

selecting a vertical printing mode in which the image is to be printed across the width of the elongate image receiving medium;

initiating a print operation for printing the image;

generating print data, in accordance with a print data generation method which ensures that the image fits in the width of the elongate receiving medium, wherein the print data generation method comprises the steps of calculating a length of the image with a first character size and comparing said length to at least two predetermined ranges, each of said predetermined ranges being associated with a predetermined character size; and printing the image with the predetermined character size corresponding to the range in which said calculated length is situated.

2. A method as claimed in claim 1 wherein the inputted data is at least one character to define the image to be printed.

3. A method as claimed in claim 2 wherein the print data generation method operates without iterative calculation of size data of said at least one character.

4. A method as claimed in claim 1, further comprising the step of generating an error message if the image with a smallest character size does not fit in the width of the receiving medium.

5. A method as claimed in claim 1, further comprising the step of inhibiting printing if the image with a smallest character size does not fit in the width of the receiving medium.

6. A method for printing an image on an elongate image receiving medium comprising the steps:

inputting data defining the image to be printed;

selecting a vertical printing mode in which the image is to be printed across the width of the elongate image receiving medium;

initiating a print operation for printing the image;

generating print data in accordance with a print data generation method which ensures that the image fits in the width of the elongate receiving medium;

wherein the print data generation method comprises the steps of:

calculating a first length of the image with a first font data;

comparing said calculated first length to a predetermined length;

calculating a second length of the image with a second font data; and printing the image using the print data.

7. A method as claimed in claim 6 wherein a first character size of a first font data is greater than a second character size of a second font data.

8. The method as claimed in claim 6 wherein the first font data is stored in the form of bit map data, and the second font data is stored in the form of second bit map data, and wherein the first length of the image calculated with a first font data is not a direct ratio of the second length of the image calculated with a second font data.

9. The method as claimed in claim 6 further comprising the step of calculating a third length of the image with a third font data, wherein the first font data is stored in the form of bit map data, and the third font data is stored in the form of third bit map data, wherein the first length of the image calculated with the first font data is not a direct ratio of the third length of the image calculated with the third font data, and wherein the first length of the image calculated with the first font data is direct ratio of the second length of the image with the second font data.

10. A printer arranged to print an image on an elongate image receiving medium comprising:

input means for inputting data defining the image to be printed;

selecting means for selecting a vertical printing mode in which the image is to be printed across the width of the elongate image receiving medium;

print operation initiating means for initiating a print operation for printing the image;

print data generating means arranged to generate print data in accordance with a print data generation method which ensures that the image fits in the width of the elongate receiving medium, wherein the print data generation method comprises calculation means arranged to calculate a length of the image with a first character size and comparing means arranged to compare said length to at least two predetermined ranges, each of said predetermined ranges being associated with a predetermined character size; and printing means arranged to print the image with the predetermined character size corresponding to the range in which said calculated length is situated using the print data.

11. A printing apparatus as claimed in claim 10, further comprising error message generating means arranged to generate an error message if the image with a smallest character size does not fit in the width of the receiving medium.

12. A printing apparatus as claimed in claim 10 further comprising print inhibiting means arranged to inhibit print if the image with a smallest character size does not fit in the width of the receiving medium.

13. A printing apparatus arranged to print an image on an elongate image receiving medium comprising:

input means for inputting data defining the image to be printed;

a memory with a first font data and a second font data;

selecting means for selecting a vertical printing mode in which the image is to be printed across the width of the elongate image receiving medium;

print operation initiating means for initiating a print operation for printing the image;

print data generating means arranged to generate print data in accordance with a print data generation method which ensures that the image fits in the width of the elongate receiving medium, wherein the print data generation method comprises calculation means arranged to calculate a first length of the image with said first data font, comparing means arranged to compare said calculated length to a predetermined length, calculation means arranged to calculate a second length of the image with said second font data; and printing means arranged to print the image using the print data.

14. A printing apparatus as claimed in claim 13 wherein said first font data has a first character size and said second font data has a second character size which is different from the first character size.

* * * * *

UNITED STATES PATENT AND TRADEMARK OFFICE

CERTIFICATE OF CORRECTION

PATENT NO. : 7,140,791 B2
APPLICATION NO. : 10/975409
DATED : November 28, 2006
INVENTOR(S) : Mario V. Bever It is certified that error appears in the above-identified patent and that said Letters Patent is hereby corrected as shown below:

In the Claims:

Claim 10 At Column 10, lines 27-28, "situated using the print data." should be -- situated. --

Signed and Sealed this

First Day of May, 2007

JON W. DUDAS
*Director of the United States Patent and Trademark Office*